United States Patent [19]

Slack

[11] Patent Number: 5,043,691

[45] Date of Patent: Aug. 27, 1991

[54] AMBIENT COMPENSATED THERMOSTAT

[75] Inventor: Douglas J. Slack, Modbury Heights, Australia

[73] Assignee: Texas Instruments Incorporated, Dallas, Tex.

[21] Appl. No.: 454,573

[22] Filed: Dec. 21, 1989

[51] Int. Cl.[5] ..... H01H 37/10; H01H 37/52

[52] U.S. Cl. ..... 337/378; 337/99; 337/354

[58] Field of Search ..... 337/378, 99, 101, 354

[56] References Cited

U.S. PATENT DOCUMENTS 2,840,664 6/1958 Anderson et al. ..... 337/101

2,942,081 6/1960 Ramsey et al. ..... 337/101

3,101,397 8/1963 Norden ..... 337/101

3,205,327 9/1965 Moorhead et al. .

*Primary Examiner*—Harold Broome

*Attorney, Agent, or Firm*—John A. Haug; James P. McAndrews; Melvin Sharp

[57] ABSTRACT

A temperature responsive electric switch is shown having an operating bimetallic member adapted to sense the temperature of a heat source coupled to an over-center switch mechanism and an ambient temperature bimetallic member to maintain a predetermined temperature delta in the operation of a thermostat regardless of changes in ambient temperature.

4 Claims, 1 Drawing Sheet

AMBIENT COMPENSATED THERMOSTAT

This invention relates generally to temperature responsive electric switches and more specifically to such switches which are provided with means to compensate for variations in ambient temperature.

Thermostatic devices are well known and are used, for example, to sense the temperature of a heat source so that upon the occurrence of a selected temperature of the heat source an electric switch is actuated or deactuated. By way of example, a thermostat has been used to sense the temperature of the exhaust air from a tumble clothes drier in order to automatically terminate the heater when the temperature of the exhaust air reaches a selected level.

A problem associated with using a thermostat in this way to determine when clothes are dry by the amount of temperature increase in the air exiting the drier is that a change in ambient temperature in the environs of the drier results in a corresponding change in the time that the heater is energized, either the heater will be energized longer than necessary if the ambient temperature has decreased thereby resulting in wasted energy or it will be energized for a shorter time than necessary if the ambient has increased thereby resulting in a drier load of clothes still being damp when the cycle has been terminated by the thermostat.

Thus an object of the invention is the provision of a thermostat which is compensated for ambient temperature fluctuations, another object is the provision of a simple, reliable, ambient temperature compensating means which is also inexpensive and easily constructed. Other objects may be had by referring to the following description and claims, taken in conjunction with the accompanying drawings.

Briefly, in accordance with the invention an elongated bimetallic operating member is cantilever mounted on one surface of a base adapted to be placed in heat sensing relation with a source of heat which is to be monitored, such as a flow of air. A switch mechanism comprising a stationary electrical contact is mounted on a second, opposed surface with an elongated support blade cantilever mounted above the second surface and a switch blade secured to a movable end of the support blade. The switch blade is provided with a movable contact adapted to move into and out of engagement with the stationary contact. A tension member is coupled to the switch blade to cooperate in causing the switch to move with snap action between the contacts engaged and disengaged positions. A motion transfer member is disposed between the operating bimetallic member and the support blade and a reaction point member is mounted above the support blade and is movable toward and away from the support blade to adjust the temperature at which the switch will operate. According to a feature of the invention, the reaction point member is mounted on a bimetallic member mounted above the support blade with the bimetallic member being exposed to the ambient in the environs of the switch. As the temperature of the environs changes the location of the reaction point is caused to shift thereby offsetting a comparable change in the location of the operating bimetallic member to result in an unchanged delta of temperature between unenergized and energized conditions.

BRIEF DESCRIPTION OF THE DRAWINGS

In order to fully appreciate the invention preferred embodiments will now be described with reference to the accompanying drawing in which

Referring to FIG. 1, Thermostat 10 comprises a base 12 formed of suitable electrically insulative material having first and second opposed sides 14, 16. An elongated bimetallic operating member 18 is cantilever mounted at 20 on the first side 14 and has a movable end 22 disposed in a recess 24 formed in base 12. A cover 26 of good thermally conductive material preferably is received over bimetal 22 to enclose recess 24.

Figure 1:
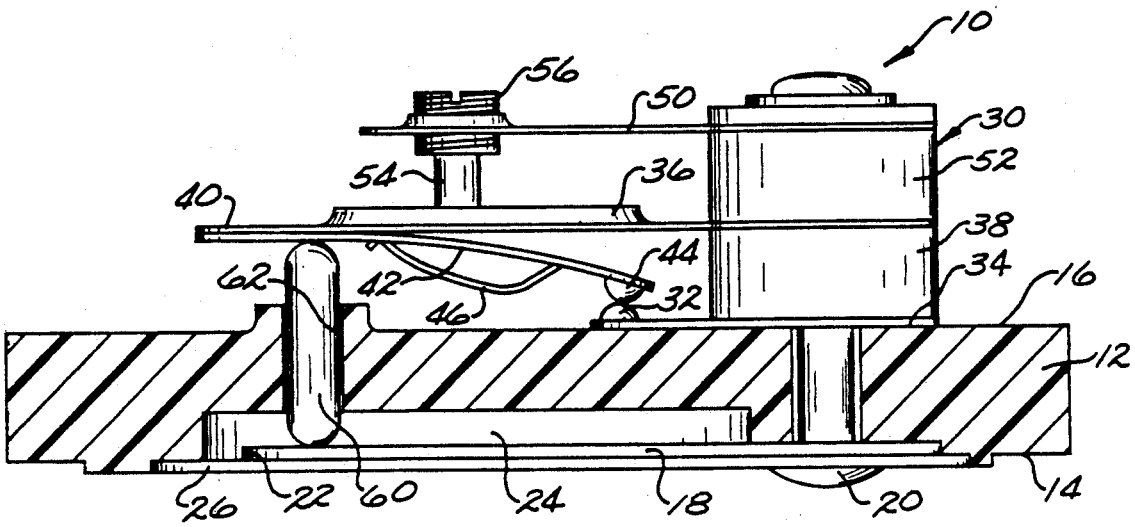
FIG. 1 is a cross section taken through a thermostat made in accordance with a first embodiment of the invention and FIG. 2 is a similar view taken through a second embodiment of the invention.

Switch mechanism 30 is mounted on side 16 of base 12 and includes stationary contact 32 mounted on stationary contact support 34, support plate 36 cantilever mounted on side 16 and spaced therefrom by insulator 38. Support blade 36 has a movable end 40 to which is attached an end of switch blade 42. A movable contact 44 is mounted on an opposite end of switch blade 42 and is adapted to move into and out of engagement with stationary contact 32. A tension member 46 is coupled to switch blade 42 and support blade 36 to provide snap action motion between the contacts engaged and disengaged positions. The switch mechanism per se as thus far described is similar to that shown and described in U.S. Pat. No. 4,754,253, assigned to the assignee of the present invention, the disclosure of which is incorporated herein by this reference. An elongated, ambient compensating bimetallic member 50 is cantilever mounted above and aligned with support blade 36 via insulator 52. Bimetallic member 50 has a free end mounting thereon reaction point member 54 which is adapted to engage support blade 36. Reaction point member 54 is adjustably mounted, as seen at 56, to move toward and away from support blade 36 in order to adjust the operating or set temperature of the switch mechanism.

With the provision of ambient compensating bimetallic member 50 thermostat 10 will switch at a predetermined temperature above ambient and will maintain the delta temperature regardless of ambient temperature changes. The compensating bimetal, in direct contact with ambient air in the environs of the thermostat, is used to set the switch point temperature while the operating bimetallic member is used to drive the switch mechanism through motion transfer member 60, slidably received in bore 62 formed in base 12, extending between the movable end 22 of bimetallic member 18 and end 40 of support member 36. When the switch point is reached the switch mechanism 30 is driven over-center and the switch contacts are disengaged. Should ambient temperature increase the compensating bimetal will move away from the switch mechanism requiring an increased equivalent movement from the operating bimetal thereby maintaining the temperature delta above ambient. A downward shift of ambient temperature results in the opposite operation with the compensating bimetal moving closer to the switch mechanism.

Thermostat 10 has been used with a tumble clothes drier with the thermostat mounted so that cover 26 is in optimum heat transfer relation with the flow of exhaust air. The thermostat switched off the heater of the clothes drier when the exhaust air reached a delta of 32 degrees above ambient and caused the cycle to terminate when the exhaust air returned to ambient.

It will be understood that the thermostat is also useful for various other control purposes. It should be understood that although a specific embodiment has been described by way of illustrating the invention, the invention includes all modifications and equivalents of the disclosed embodiment falling within the scope of the appended claims.

Figure 2:
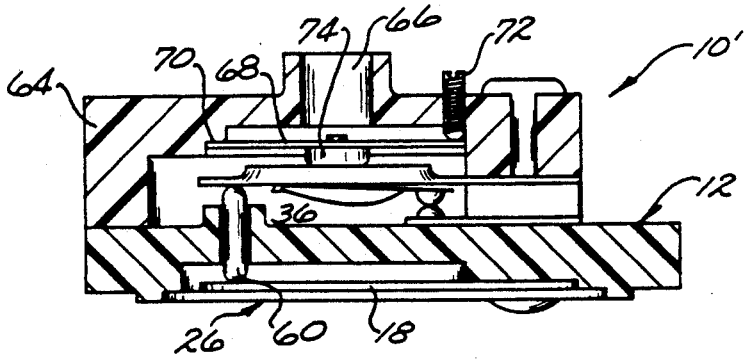

While the FIG. 1 embodiment is effective to provide the desired ambient compensation it is subject to calibration problems in that mere engagement of the screw means 56 with adjusting means, e.g. a screw driver, even without rotation of the screw means, can result in some deflection of the bimetallic member 50 and consequently affect the set temperature of the thermostat. FIG. 2 shows an embodiment which is more conducive to reliable, accurate calibration.

Thermostat 10' is provided with a bracket or housing member 64 having an ambient air port 66 in communication with a compensating bimetal member 68. Bimetal 68 is an elongated member having a free end received on a first seat, shelf 70, and an opposite free end on a second seat in engagement with a calibrating screw 72. A reaction point member 74 is mounted on the bimetal member 68 intermediate its ends in alignment with support blade 36. Bimetal member is in effect captured between shelf 70, screw 72 and support blade 36. In this embodiment calibration is not affected until screw 72 is rotated.

I claim:

1. An ambient compensated thermostat comprising a base member having first and second opposed surfaces, an elongated operating bimetallic member cantilever mounted on the first surface to sense the temperature of a heat source, the bimetallic member having a free end, a support blade having a fixed end cantilever mounted on the second surface of the base member with a movable end extending over the second surface, a motion transfer member extending between the movable end of the support blade and the free end of the bimetallic member, a stationary contact mounted on the second surface of the base member, a switch blade having a first end secured to the movable end of the support blade for movement with the movable end of the support blade, the switch blade having a movable contact at an opposite end thereof movable between positions in and out of engagement with the stationary contact, a tension member coupled to the switch blade intermediate the ends of the switch blade, a housing member received on the base member and extending over the support blade, a recess having first and second ends formed in the housing member overlying the support blade, seating means formed adjacent the first and second ends of the recess, an elongated ambient compensating bimetallic member having opposite free ends disposed in the recess with the free ends received on the seating means at respective first and second ends of the recess, and a reaction point means mounted on the ambient compensating bimetallic member intermediate its opposite free ends and being in engagement with the support blade to capture the ambient compensating bimetallic member in the seating means and to set the switch set point temperature whereby changes in ambient temperature will cause movement in the reaction point means to offset comparable changes in deflection of the elongated operating bimetallic member.

2. A thermostat according to claim 1 in which the reaction point means is mounted on a central portion of the ambient compensating bimetallic member.

3. An ambient compensated thermostat according to claim 1 in which the seating means comprises a shelf formed in the housing member adjacent one end of the recess and a member adjustably movable toward and away from the support blade mounted in the housing member adjacent the second end of the recess to selectively adjust the set point temperature of the thermostat.

4. An ambient compensated thermostat according to claim 1 in which an air port is formed in the housing member in communication with the ambient compensating bimetallic member disposed in the recess.

* * * * *